US007216602B2

(12) United States Patent
Towley, III et al.

(10) Patent No.: US 7,216,602 B2
(45) Date of Patent: May 15, 2007

(54) SEASONAL, MULTI-USE, MULTI-LEVEL STRUCTURE TRANSPORTABLE BOTH BY GROUND AND WATER FOR USE IN A BODY OF WATER

(75) Inventors: Carl K. Towley, III, Alexandria, MN (US); Gregory S. Olson, Owatonna, MN (US)

(73) Assignee: Intellex, Inc., Owatonna, MN (US)

( * ) Notice: Subject to any disclaimer, the term of this patent is extended or adjusted under 35 U.S.C. 154(b) by 0 days.

(21) Appl. No.: 11/175,998

(22) Filed: Jul. 6, 2005

(65) Prior Publication Data

US 2006/0278154 A1 Dec. 14, 2006

Related U.S. Application Data

(63) Continuation-in-part of application No. 11/150,048, filed on Jun. 10, 2005.

(51) Int. Cl.
*B63C 13/00* (2006.01)

(52) U.S. Cl. ..... 114/344; 280/414.1

(58) Field of Classification Search ..... 114/44, 114/45, 263, 264, 266, 267, 344; 280/414.1; 135/97; 414/494, 495
See application file for complete search history.

(56) References Cited

U.S. PATENT DOCUMENTS 3,126,855 A * 3/1964 Freeburg ..... 114/45
3,626,447 A 12/1971 Hindlin
3,857,352 A * 12/1974 Schott ..... 114/267
3,895,592 A * 7/1975 King ..... 114/45
4,084,529 A 4/1978 Katernberg
4,092,755 A * 6/1978 Hughes ..... 114/344
4,188,056 A * 2/1980 Watson ..... 280/414.1
5,131,342 A * 7/1992 Sackett ..... 114/344
5,478,166 A 12/1995 Starr
6,520,102 B1 2/2003 Johnson

OTHER PUBLICATIONS

Float-N-Go Brochure (undated but admitted prior art).
Floatation Systems Brochure (undated but admitted prior art).

* cited by examiner

*Primary Examiner*—Lars A. Olson
(74) *Attorney, Agent, or Firm*—James W. Miller

(57) ABSTRACT

A multi-use, multi-level structure can be installed in and removed from a body of water in a seasonal fashion. The structure has a lower level that includes a boat lift and an upper level that provides an entertainment area. The structure carries a buoyancy system for selectively floating the structure on the body of water or sinking the structure in the water. The buoyancy system preferably comprises a ballast system that includes an array of hydraulically interconnected ballast tanks that are vented to the atmosphere. A valve may be opened to admit water to the ballast tanks to flood the tanks. A pump is used to pump water out of the ballast tanks when desired.

6 Claims, 10 Drawing Sheets

SEASONAL, MULTI-USE, MULTI-LEVEL STRUCTURE TRANSPORTABLE BOTH BY GROUND AND WATER FOR USE IN A BODY OF WATER

CROSS REFERENCE TO RELATED APPLICATIONS

This application is a continuation-in-part of application Ser. No. 11/150,048 filed Jun. 10, 2005.

TECHNICAL FIELD

This invention relates to a structure used in a body of water such as a lake. More particularly, this invention relates to a structure that is installed in and removed from the body of water in a seasonal fashion, i.e. installed in and used in the body of water during the spring and summer and removed from the body of water and stored on land during the fall and winter.

BACKGROUND OF THE INVENTION

The recreational boating industry involves the use of a watercraft, such as a jet ski or boat, on a body of water. Many different structures have been developed to facilitate the use of and enjoyment of such watercraft. One such structure is a boat lift and an adjoining dock. The boat lift includes a movable cradle that may be raised and lowered to lift the watercraft into a storage position out of contact with the water or drop the watercraft into a use position in which the watercraft floats on the water. The cradle of the boat lift may be powered either manually or by some type of motor.

In northern locales where the body of water freezes during the winter, boat lifts and docks are typically used seasonally. Usually, a boat lift/dock is installed in the body of water in the spring and used throughout the summer. Then, prior to the onset of cold weather in the late fall, the boat lift/dock is removed from the body of water and stored on land during the winter. This prevents the boat lift/dock from being damaged by ice formed in the body of water during the winter.

Installing and removing a boat lift or dock from a body of water is often a very strenuous and difficult operation. While docks come in sections to allow a dock to be disassembled and removed piece by piece, the same is not true of a boat lift. A boat lift is typically provided as one assembled, unitary structure. Thus, a boat lift often has to be man-handled into and out of the water using brute force. This usually requires a number of strong, fit people who often must be specifically hired for the job.

The boat lift installation and removal problem is made even worse if the shorefront property over which the boat lift must travel to the body of water is steep, rocky or uneven or the beach is narrow or non-existent. Most prime shorefront property having relatively wide, smooth and flat beaches has already been developed. Thus, owners of more newly developed shorefront property may have an impossible time of installing and removing a boat lift or dock from the water. It often can't be done if there is a large drop or highly uneven terrain between where the boat lift or dock must be stored out of season and where the boat lift or dock is to be installed and used during the season.

In addition, some boat lifts are part of larger, multi-level structures that include an entertainment area, such as a patio or sundeck, in a second level located above the boat lift. Obviously, such multi-level structures are considerably heavier and more complex than a boat lift or dock alone. To date, such multi-level structures are only used in climates where they can be assembled in place in the body of water and left year round. Thus, the use of such multi-use, multi-level structures has been restricted to bodies of water that remain open and ice free year round.

There is a need in this art for a simpler, easier way of installing and removing structures such as boat lifts and docks from a body of water. In addition, there is a need to find some way of being able to install and remove a multi-use, multi-level structure from a body of water without having to assemble and disassemble such structure in place. This invention addresses these and other needs.

SUMMARY OF THE INVENTION

One aspect of this invention relates to a structure that may be used in a body of water. The structure comprises a multi-level structure having a lower level and an upper level. The lower level is tall enough to accommodate at least a watercraft therein. The upper level includes a weight bearing deck that is strong enough to support a plurality of people and furniture in a first entertainment area on the structure. At least a pair of wheels can be at least temporarily attached to the lower level of the structure to allow the structure to be transported by ground to and from the body of water and to be rolled into and out of the body of water. A buoyancy system is carried on the structure to selectively provide the structure with a buoyant state in which the structure floats on the body of water and a non-buoyant state in which the structure does not float on the body of water.

BRIEF DESCRIPTION OF THE DRAWINGS

This invention will be described more completely in the following Detailed Description, when taken in conjunction with the following drawings, in which like reference numerals refer to like elements throughout.

DETAILED DESCRIPTION

Figure 1:
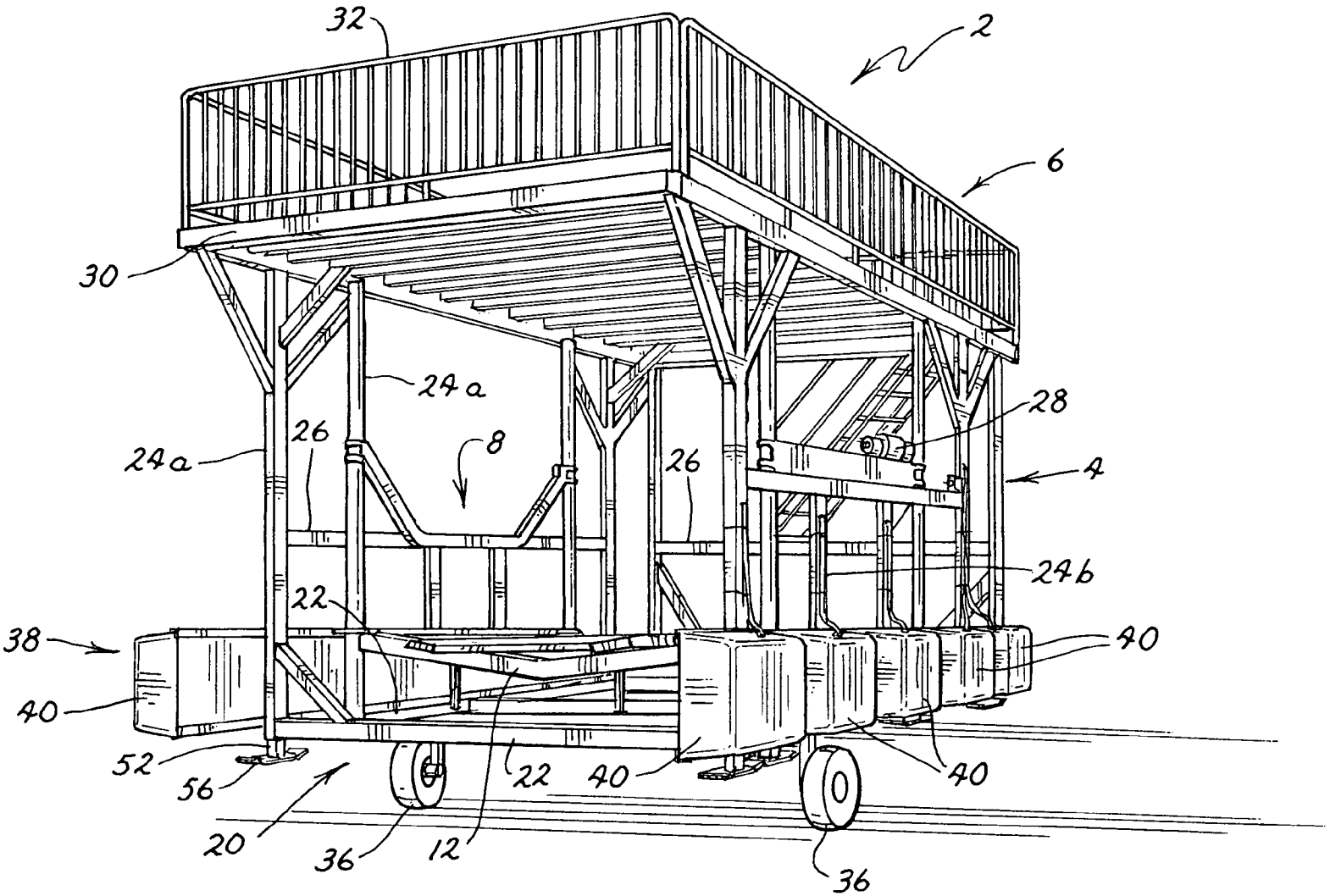
FIG. 1 is a perspective view of a first embodiment of a structure according to this invention, particularly illustrating a multi-level structure providing a boat lift on the lower level and an entertainment area on the upper level, the structure being shown disposed on the ground for ground transport.

One embodiment of a structure according to this invention is shown in FIG. 1 generally as 2. Structure 2 preferably has two stories or levels comprising a lower level 4 and an upper level 6. Lower level 4 preferably contains a vertically movable boat lift 8 for holding a watercraft such as a boat 10 or jet ski. Lower level 4 is open along a rear end to allow boat 10 to be driven from a body of water into lower level 4 of structure 2 and positioned atop a cradle 12 of boat lift 8.

Figure 2:
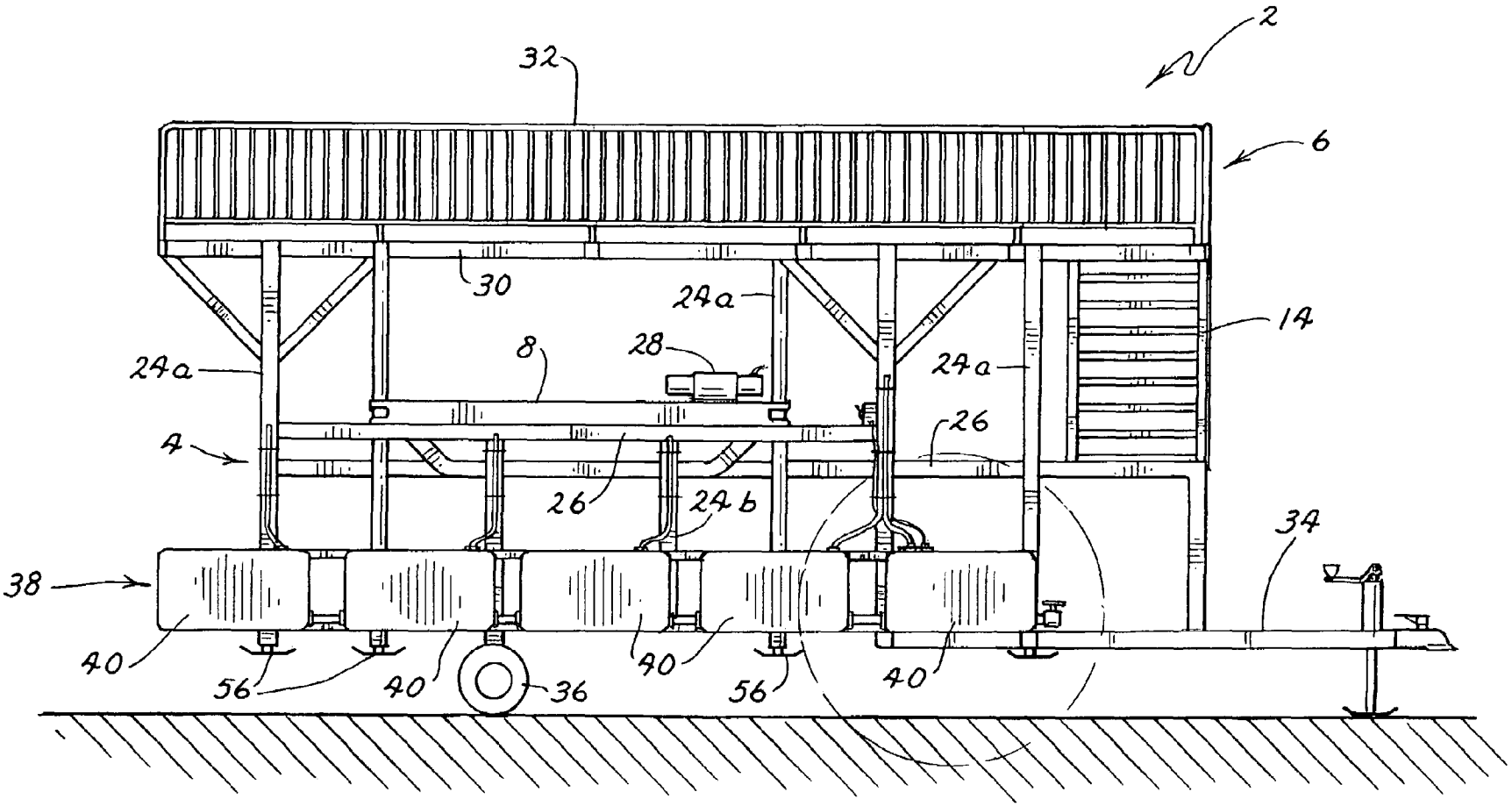
FIG. 2 is a side elevational view of the structure shown in FIG. 1.
Figure 3:
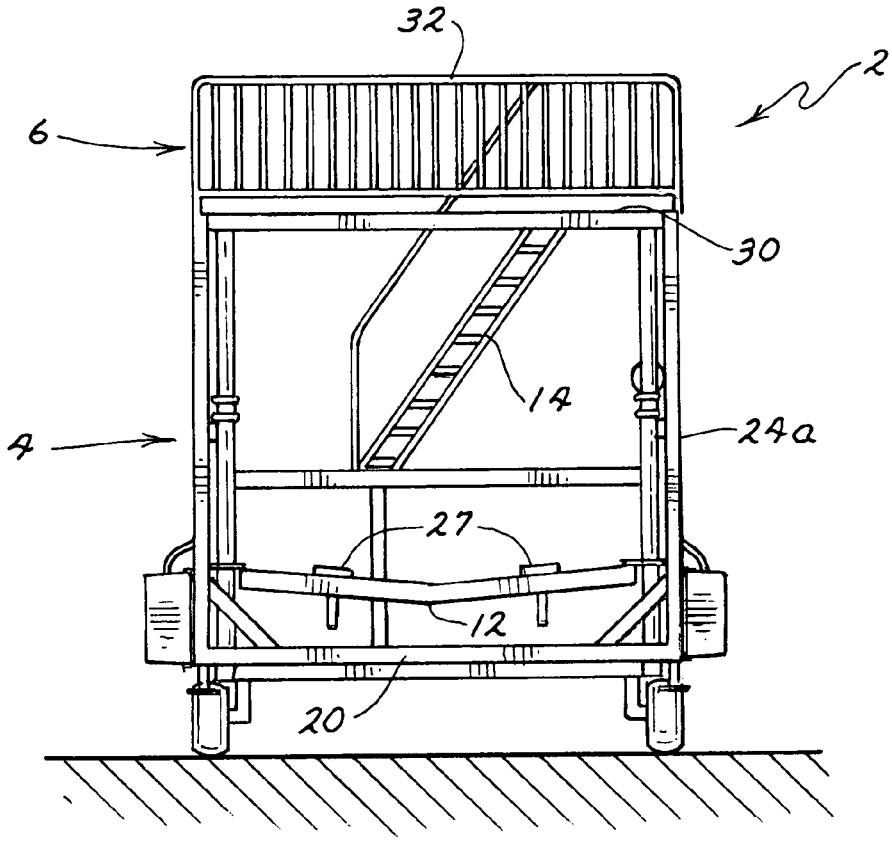
FIG. 3 is a rear elevational view of the structure shown in FIG. 1.
Figure 6:
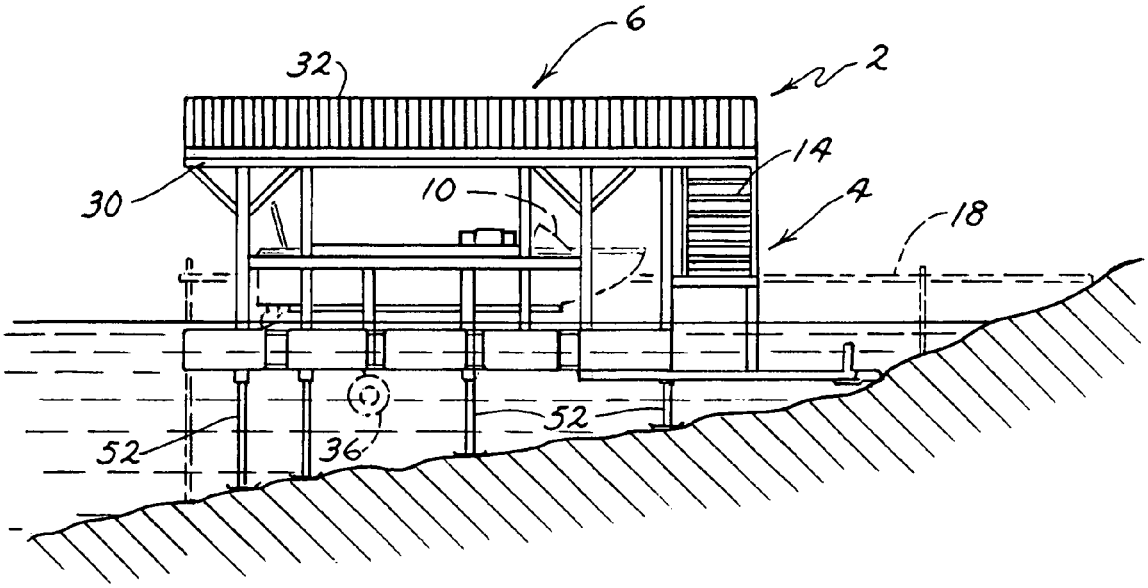
FIG. 6 is a side elevational view similar to FIG. 5, but illustrating the structure having been sunk into the bottom of a body of water adjacent a shoreline, the ballast system having been filled with water to provide ballast for the structure.

Upper level 6 preferably provides an entertainment area for people and their guests. Structure 2 includes a stairway 14 at the front end for allowing people to ascend to the entertainment area provided by upper level 6 of structure 2. Stairway 14 can extend down only a portion of the height of lower level 4 as shown in FIG. 2. This allows the bottom of stairway 14 to mate with a landing or dock 18 extending from the shoreline at an elevation above the base 20 of lower level 4 as shown in FIG. 6.

Lower level 4 has a substantially rectangular base 20 formed as an open framework by a plurality of longitudinal and transverse beams 22 that are rigidly connected together by being welded or bolted together. Base 20 comprises an open framework. By this, it is meant that base 20 is open to the passage of water and lacks a hull or solid bottom that would permit direct flotation of structure 2. Thus, without the ballast system 38 of this invention whose operation will be described hereafter, structure 2 would otherwise sink when placed into a body of water.

Lower level 4 of structure 2 is formed by a plurality of uprights 24 that extend vertically upwardly from base 20 along the peripheral sides of base 20. Some of the uprights 24*a* extend full height to upper level 6 of structure 2. Other uprights 24*b* extend only a few feet up from base 20. Side rails 26 can extend between uprights 24*a* and over the tops of partial height uprights 24*b* to form partial height, open side walls along three sides of lower level 4. No partial height side wall is present at the open rear end of lower level 4 to allow a boat to be driven into lower level 4 and to have access to boat lift 8.

A standard boat lift 8 is housed in lower level 4 of structure 2. Boat lift 8 comprises a V-shaped cradle 12 having a plurality of rollers or pads 27 for engaging against the hull of a boat 10. See FIGS. 11 and 12. Cradle 12 vertically slides up and down on some of the full height uprights 24*a* of structure 2. A lifting apparatus 28, such as an electrically powered or hand powered winch, lifts and lowers cradle 12 from a lowered watercraft receiving position to a raised watercraft storage position shown in FIG. 6. Such boat lifts 8 are well known in the boating industry and need not further be described herein.

Upper level 6 of structure 2 comprises a weight bearing floor or deck 30 supported by the upper ends of the full height uprights 24*a*. A safety railing 32 is preferably provided around the periphery of deck 30 to prevent people and objects from falling off deck 30. Stairway 14 provides access to deck 30 and may join deck 30 through an opening (not shown) in deck 30. Obviously, people can ascend stairway 14 to be able to pass through such opening and gain access to deck 30. Alternatively, stairway 14 could be placed along one side of deck 30 with access to deck 30 being provided through an opening in safety railing 32.

Deck 30 which forms upper level 6 of structure 2 provides an entertainment area in which people, such as the owners of structure 2 and their guests, may gather for entertainment. Deck 30 is sufficiently strong to bear the weight of various people standing thereon along with pieces of furniture (e.g. patio chairs, tables, etc.) or entertainment equipment (e.g. barbecues, stereos, etc.) carried thereon. Play equipment suited for water recreation (e.g. diving boards, water slides, ropes, etc.) can be attached to the sides of deck 30 and/or extended out from deck 30. In addition, all or part of deck 30 could be covered with a removable roof or canopy (not shown) to help protect the people using deck 30 from the elements. Thus, upper level 6 of structure 2 provides a conveniently located entertainment area that complements the outdoor, water based environment in which structure 2 is used.

Base 20 includes a tow hitch and a pair of ground engaging wheels 36 to allow structure 2 to be towed over the ground, such as over a road or the like. The tow hitch comprises a tow tongue 34 that extends from the front end of base 20 of lower level 4 of structure 2. Tow tongue 34 is connected in any suitable manner, i.e. by a ball and socket hitch, to a tow vehicle (not shown), such as a pickup truck, SUV, or the like.

Wheels 36 are rotatably carried on the underside of base 20 of lower level 4 by any suitable axle and bearing structure. Wheels 36 and their associated axles and bearings are all rated for highway use. Wheels 36 can be permanently mounted on base 20. However, wheels 36 are preferably of a removable type to allow wheels 36 to be selectively installed on and removed from base 20. This removal is indicated in FIG. 6 by the phantom line illustration of wheels 36.

Preferably, wheels 36 are the usual pneumatic type rubber wheels that are typically used on cars and on boat trailers with wheels 36 being inflated by air. This allows structure 2 to be towed at reasonably high towing speeds, such as 25 to 35 mph, that are substantially above walking speeds. Thus, if structure 2 is towed at such speeds, then structure 2 will not impede the flow of traffic at least on most non-freeway type roadways. In addition, such wheels 36 allow structure 2 to be towed over long distances if need be.

Structure 2 preferably includes a ballast system 38 that provides positive buoyancy for structure 2 when ballast system 38 is completely or even partially empty of water, but that provides sufficient weight to structure 2 to substantially anchor structure 2 in place in a body of water when ballast system 38 is full of water. In addition, ballast system 38 can be partially filled with water to any desired degree to provide a desired mix of buoyancy and weight such that structure 2 can be stably transported across a body of water. For example, given the relatively top heavy nature of structure 2, ballast system 38 might always be at least partially filled with water to provide enough weight to prevent structure 2 from capsizing or being blown over while structure 2 is floating or being transported on the water. The amount of ballast weight provided by ballast system 38 can be easily adjusted by adding water to ballast system 38 to take into account any environmental conditions that might be present, such as high winds on the body of water.

Ballast system 38 comprises a plurality of substantially rigid, hollow ballast tanks 40, made from either metal or a strong, durable plastic material, secured as low as possible to lower level 4 of structure 2. As shown in FIGS. 1–5, ballast system 38 can comprise a horizontal row of five tanks 40 along one side of lower level 4 of structure 2. A similar row of five tanks 40 is disposed along the opposite side of lower level 4 of structure 2. Each row of tanks 40 is secured to lower level 4 of structure 2 substantially adjacent base 20 of lower level 4.

Each row of tanks 40 is preferably outboard of each side of lower level 4 of structure 2 to not intrude into the space occupied by boat lift 8. Each individual tank 40 is rectangular but could have other shapes. Tanks 40 within each row are oriented generally vertically to minimize the width of structure 2 when tanks 40 are in place thereon. See FIGS. 1 and 3 which illustrate the outboard, vertical orientation of tanks 40. Tanks 40 can be secured to structure 2 in any suitable manner, e.g. by strapping tanks 40 to the sides of structure 2, etc.

Figure 4:
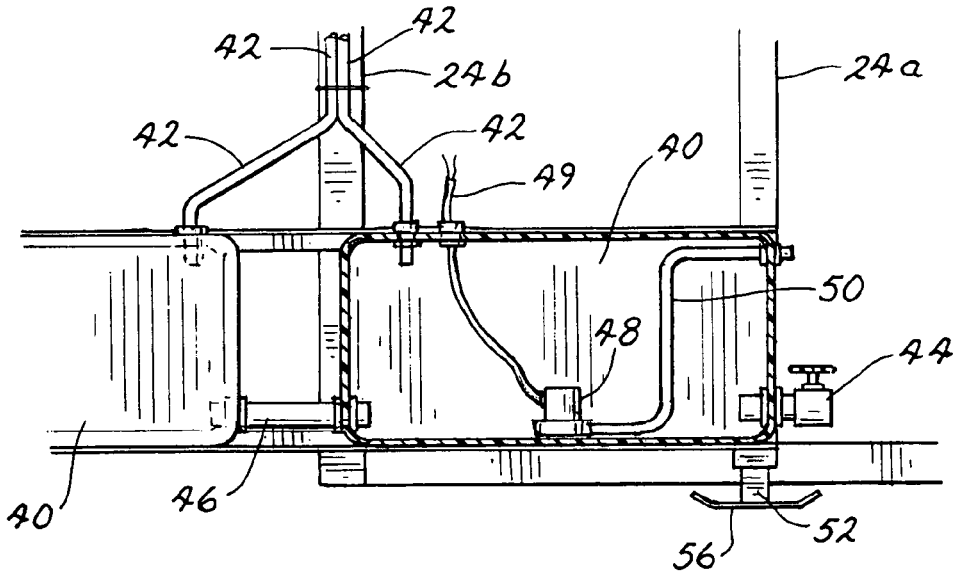
FIG. 4 is an enlarged side elevational view, partly shown in cross-section, of that portion of the ballast system shown in the circled portion of FIG. 2, particularly illustrating a pair of interconnected ballast tanks and a bilge pump inside one of the tanks for pumping water out of the interconnected ballast tanks.

Referring now to FIG. 4, each individual tank 40 of ballast system 38 includes an air vent comprising an upwardly extending snorkel tube 42. The lower end of tube 42 enters into the top of tank 40. The upper end of tube 42 extends upwardly along the side of lower level 4 and is secured to one of the uprights 24. Tube 42 is long enough so that the upper end of tube 42 remains above the water line even when ballast system 38 is completely filled with water and structure 2 has sunk to its maximum depth in a body of water.

Referring further to FIG. 4, one ballast tank 40 in each row has a hand operated fill valve 44 in one end thereof. In addition, all tanks 40 in each row are interconnected or plumbed together by a plurality of hydraulic couplings 46 with one coupling 46 extending between and interconnecting each two adjacent tanks 40. Thus, from a hydraulic standpoint, the individual tanks 40 in each row of tanks act collectively act as a single long tank and, in fact, could be replaced by such a single tank. However, it is more practical and economical to join a plurality of smaller tanks 40 together along each side of structure 2 than to use one long tank.

One tank 40 in each row of tanks has an electrically operated bilge pump 48 installed in the bottom of tank 40 as shown in FIG. 4. Bilge pump 48 is coupled to a drain line 50 that is routed out through the side of tank 40 adjacent the top of tank 40. Drain line 50 is sealed where it passes through the wall of tank 40 to prevent water from leaking into tank 40 around drain line 50. The only path for water to enter ballast system 38 is through the manually operated fill valve(s) 44.

Bilge pump 48 is powered by an electrical supply line 49 that brings electrical power to bilge pump 48 from a source of electrical power. Preferably, this electrical power source is carried on structure 2 and comprises a simple battery placed somewhere on structure 2, i.e. on deck 30 of upper level 6. This battery could be rechargeable using solar power. Alternatively, the source of electrical power could be external to structure 2, such as a battery on a boat or a land based electrical power line extending to structure 2.

To fill each row of ballast tanks, the user need only manually open fill valve 44 to allow water to flow into tanks 40 on that side of structure 2. Desirably, fill valves 44 on both rows of ballast tanks are opened at the same time to allow the dual rows of ballast tanks to fill evenly. As water enters each row of ballast tanks, the water will fill all tanks 40 in each row in an even progressive manner due to the interconnecting couplings 46 between tanks 40. The air vents 42 provided in the tops of tanks 40 allow air to escape from tanks 40 during the tank filling process. When tanks 40 have been filled to a desired amount, the user need only close fill valves 44 by turning the handle on each fill valve 44 to a closed position.

Conversely, to empty each row of ballast tanks, the user need only energize bilge pump 48 for that row of tanks using any suitable switch or control (not shown) in the electrical supply to bilge pump 48. Bilge pumps 48 in the dual rows of ballast tanks desirably have identical pumping rates. In addition, bilge pumps 48 are preferably actuated at the same time so that water is pumped out of each row of ballast tanks at the same rate and at the same time. To ensure bilge pumps 48 are always activated at the same time, a single control or switch could be wired into the electrical supply circuits to both pumps so that they both operate together whenever the control or switch is selectively closed by the user.

Preferably, each bilge pump 48 will pump water out of whatever tank 40 in which it is contained at a rate that is less than the rate at which water can flow through the interconnecting couplings 46. Thus, water within the row of tanks will lower in a steady, even fashion, i.e. tank 40 containing bilge pump 48 is not pumped dry ahead of the other tanks in the same row. This is done by oversizing the hydraulic couplings 46 relative to the size of drain line 50 and the pumping rate of pump 48.

Structure 2 provided by this invention can be easily installed in a body of water or removed from a body of water to allow seasonal use even though structure 2 is a multi-level structure. For example, assume that it is spring and structure 2 has been stored out of the water on land as is necessary in northern climates where the body of water in which structure 2 is normally used freezes. In this condition, wheels 36 are in place on base 20. At some point during the spring, the body of water will thaw and the user of structure 2 will decide to put structure 2 into the water.

To put structure 2 in the water, the user need only connect a tow vehicle to tow tongue 34. The vehicle is then used to tow structure 2 to the body of water in which it is be installed. The use of conventional pneumatic, rubber wheels 36 and a conventional hitch allows structure 2 to be towed over at roadway at normal non-freeway type speeds. Once the user reaches the body of water, the user can then back structure 2 into the water. This can be done either proximate to where structure 2 is to be installed in the body of water, i.e. on the user's own property, or remotely from where structure 2 is to be installed, i.e. at a boat ramp that may be remote from the user's own property such as a boat ramp located on the other side of the lake.

Of course, when structure 2 is first backed into the water during the spring, tanks 40 in ballast system 38 will be largely or completely dry since structure 2 has been out of the water over the winter. Thus, structure 2 upon entering the water will be naturally buoyant without having to do anything since the dry tanks 40 will provide their maximum buoyancy. If structure 2 is situated at its final desired location immediately upon entry into the water, fill valves 44 may be used to completely flood tanks 40. However, some amount of final positioning or even extended transport over the body of water may often be required. Thus, the user will preferably open fill valves 44 on ballast system 38 and partially flood tanks 40 on either side of structure 2 until some water enters tanks 40 and provides some stability to structure 2 but structure 2 as a whole is still buoyant.

Figure 5:
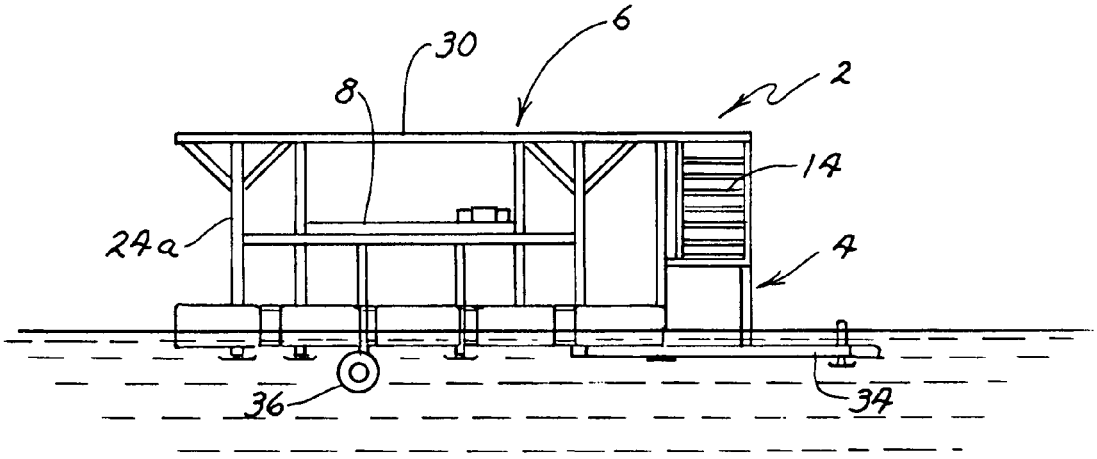
FIG. 5 is a side elevational view of the structure shown in FIG. 1, particularly illustrating the structure floating on water for water transport, the ballast system providing a desired amount of buoyancy for such water transport.

With a partially flooded ballast system 38, structure 2 will still float on the water but will have sufficient stability to allow structure 2 to be accurately positioned. For example, the user can then push or pull on structure 2 to float it however many feet or yards is required until structure 2 is positioned exactly where it is to be installed. If structure 2 has been put into the body of water at a remotely located boat ramp, then structure 2 may have to be towed across the body of water to reach its destination and then positioned by hand. In either case, the use of partially flooded ballast tanks 40 allows such water transport to occur, either over short or long distances. FIG. 5 illustrates structure 2 in this condition floating on a body of water.

Once structure 2 has been exactly positioned where the user likes, then fill valves 44 can be opened again and ballast system 38 completely flooded to provide the maximum ballast weight to structure 2. This will sink structure 2 in the body of water to the maximum possible depth as shown in FIG. 6. In this condition, at least some of lower level 4 of structure 2 up as far as the top of tanks 40 will be submerged Ideally, however, legs 52 (described hereafter) will be adjusted so that the tops of tanks 40 are somewhat below the water surface when structure 2 is resting on the bottom to prevent tanks 40 from collecting waterborne debris. This is shown in FIG. 6.

The amount of weight added by ballast system 38 is significant and is preferably large enough so that structure 2 becomes substantially immovable in the water. For example, with ten ballast tanks as shown on structure 2 of FIG. 1 and with each ballast tank holding 60 gallons of water, the amount of weight added to structure 2 when ballast system 38 is completely filled with water is about 5000 lbs. (600 gallons*8.34 lbs. per gallon). The gross weight of structure 2 shown in FIG. 1 without any water in tanks 40 is only 2450 lbs. Thus, ballast system 38 when fully filled approximately triples the dry gross weight of structure 2 to help anchor structure 2 in place. Obviously, ballast system 38 when partially filled will help provide such additional weight to structure 2 needed to provide dynamic stability to structure 2 when structure 2 is being transported or floated on the surface of the body of water. If structure 2 were built with only a single lower level comprising a boat lift 8 covered by a canopy, the additional weight provided by ballast system 38 would help keep structure 2 and boat lift 8 in place even in strong winds and with boat lift 8 empty, thus solving another problem faced by conventional non-ballasted boat lifts.

Hydraulic couplings 46 between tanks 40 in each row of tanks could have individual shut off valves (not shown) therein to allow tanks 40 to be trimmed between the front and rear ends of structure 2. Suppose a relatively heavy hot tub or spa is carried on one end of deck 30. Then, when tanks 40 are filled with water, the tanks 40 beneath the end carrying such hot tub or spa could be individually shut off before all the tanks 40 in the row are completely filled with water. This would selectively provide the shut off tanks 40 with less water and more air to make such tanks 40 at least partially buoyant to better support the heavier loads on that end of structure 2. Side to side trimming of structure 2 can be done by selectively filling the ballast tanks 40 on one side of structure 2 to a greater or lesser degree than the ballast tanks 40 on the opposite side of structure 2.

At least some of the uprights 24 of structure 2 have telescopic legs 52 extending out of the bottom thereof. Such legs 52 can be selectively extended from the bottom of such uprights 24 to engage against the bottom of the body of water at the location where structure 2 is being installed. Any suitable means can be provided for locking legs 52 in their extended lengths, e.g. locking pins (not shown) selectively insertable through one of a plurality of locking holes 54 provided along the length of legs 52. See FIG. 15. Such legs 52 further secure and support structure 2 in place as shown in FIG. 6.

Preferably, the lower ends of legs 52 terminate in feet 56 for engaging against the bottom of the body of water when legs 52 are extended. It is preferred that legs 52 be extended and feet 56 placed against the bottom of the body of water when ballast system 38 is partially flooded but not completely flooded. Then, when ballast system 38 is completely flooded, the additional weight will help sink feet 56 on legs 52 into the bottom of the body of water. This will enhance the ability of legs 52 to help secure structure 2 in place.

In shallow locations where the depth of the bottom is relatively shallow and constant, wheels 36 may be removed from structure 2 as indicated by the use of dotted lines in FIG. 6. Such wheels may also be removed even if the bottom depth would be sufficient to accommodate them simply to prevent wheels 36 from being constantly submerged in water during the length of time that structure 2 is installed in the water and is in use. This will help prevent wheels 36 and, more importantly, the wheel bearings from deteriorating due to too much water exposure. The bearings will typically be protected by a seal on the wheel axle which seal is often called a Bearing Buddy, but such seals are not guaranteed for prolonged water submersion.

As shown in FIG. 6, once structure 2 is in place in the water, a landing or dock 18 may be extended from the shoreline to structure 2 to facilitate access to structure 2. Desirably, dock 18 will be at the level of the bottom of stairway 14 so that a person walking on dock 18 may simply ascend stairway 14 to access the entertainment area provided by upper level 6. Dock 18 may be installed so that it is simply adjacent to structure 2 but not connected thereto. Alternatively, structure 2 may be provided with various connectors or sockets (not shown) so that dock 18 may be physically coupled or attached to various portions of structure 2.

Structure 2 of this invention for the first time allows a user to transport a multi-level structure over a road via ground engaging wheels 36 on structure 2 and to install and remove such a structure from a body of water for seasonal use. In addition, ballast system 38 allows this to be done with a minimum of manpower and effort. Ballast system 38 when partially flooded allows the user to achieve a desired balance between buoyancy and weight so that structure 2 can be floated on the surface of the water even over long distances. Ballast system 38 when completely flooded provides sufficient weight to substantially anchor structure 2 in place in the body of water.

Moreover, ballast system 38 of this invention is particularly safe, durable and easy to use. Tanks 40 will normally be dry and buoyant when structure 2 is being placed into the water, during the spring or early summer. Thus, the user need do nothing to make structure 2 buoyant and must only back structure 2 into the water where it will float. The user can then adjust the buoyancy to partially flood tanks 40 to make structure 2 more stable to allow structure 2 to be more safely transported across the water. With structure 2 in its intended final destination, the user can then completely flood tanks 40 to sink structure 2 down into the water to its desired maximum depth, after having first extended legs 52 to engage the bottom of the body of water. If necessary, wheels 36 can be removed at any point in this process after structure 2 has been backed into the water. All of this can be done without needing any power or compressed air since tanks 40 are flooded merely by opening the manually openable and closable fill valves 44.

Once the season ends and structure 2 is to be removed from the water, wheels 36 need to be reinstalled if they have been removed and telescopic legs 52 raised. Ballast system 38 needs to be emptied of water. This is done merely by switching on the electrically operated bilge pumps 48 in each row of ballast tanks 40. Such bilge pumps 48 can be used to partially or fully empty tanks 40 of added water. Structure 2 can then be pulled out of the water and towed to a desired storage location using tow tongue 34 and ground engaging wheels 36.

When structure 2 is being pulled over public roads and the like, the height and width of structure 2 must conform to any applicable governmental limits. Accordingly, upper level 6 of structure 2 can be no higher than the prescribed maximum height permitted by law. In this respect, it may be necessary to dismount safety railing 32 provided on deck 30 as shown in FIG. 5 or alternatively to pivotally mount such railing to deck 30 to allow railing 32 to be folded flat against deck 30 or to hang down from the sides of deck 30. Obviously, any removable roof or canopy provided on upper level 6 would also have to be removed from deck 30.

The width of structure 2 can be minimized by judicious placement of tanks 40. As shown in FIGS. 1–6, vertical placement of tanks 40 along the sides of structure 2 (i.e. the long axis of tanks 40 being parallel to the sides of structure 2) is one way to do this. Another way to do this is to place such tanks largely or completely inboard of the sides of structure 2.

Figure 7:
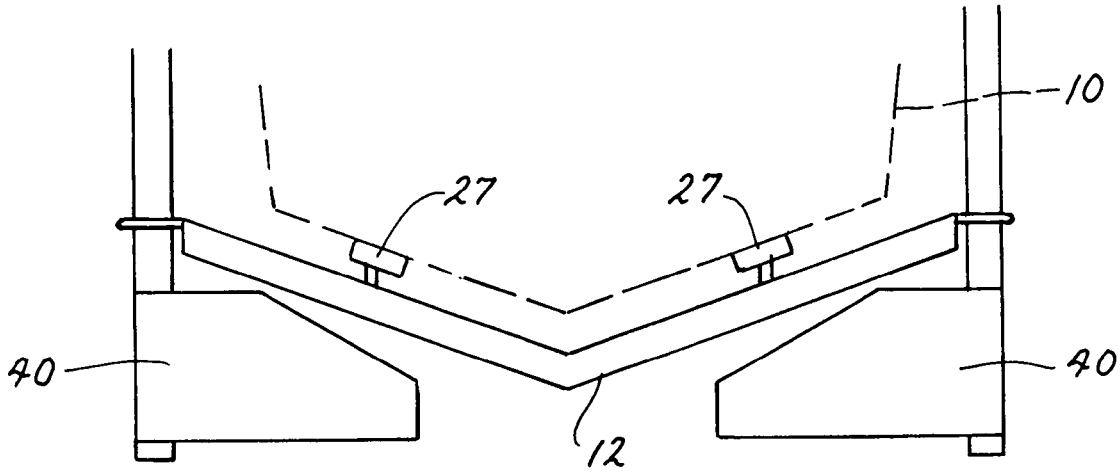
FIGS. 7 and 8 are diagrammatic rear elevational views of the structure of FIG. 1, particularly illustrating placement of the ballast tanks inboard on the structure with the ballast tanks being shaped to provide clearance to the boat lift.
Figure 8:
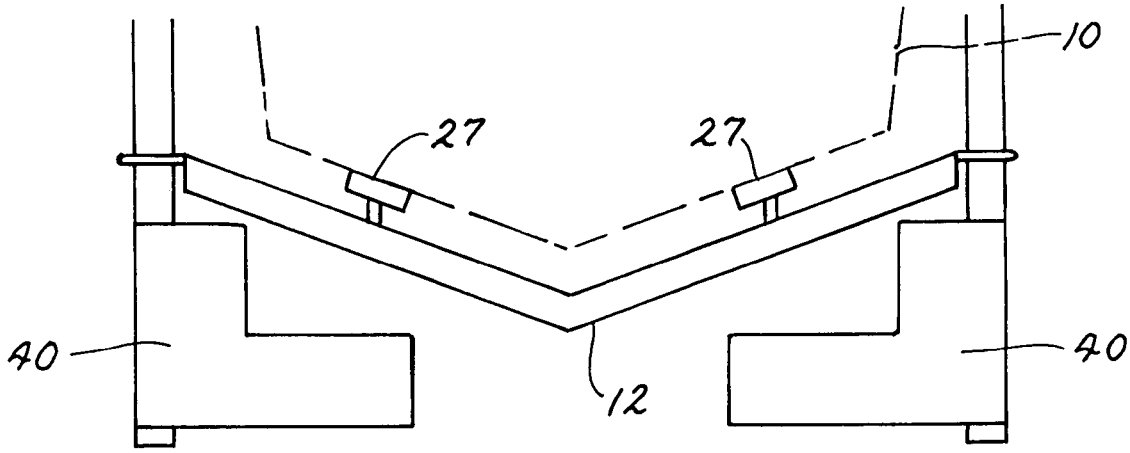

When a boat lift 8 is housed in lower level 4 of structure 2, tanks 40 when placed inboard can also be shaped to nestle beneath the V-shaped cradle 12 of boat lift 8. For example, tanks 40 can have either a slanted or L-shaped cross-section as shown in FIGS. 7 and 8. This minimizes interference with boat lift 8 while permitting inboard mounting of tanks 40. Obviously, even rectangular ballast tanks 40 extending transversely from one side of lower level 4 to the other could be used beneath boat lift 8 if so desired. However, this would entail an increase in the vertical height of structure 2 to provide sufficient clearance between the downwardly pointing midpoint of the V-shaped cradle 12 and such a tank 40.

Figure 9:
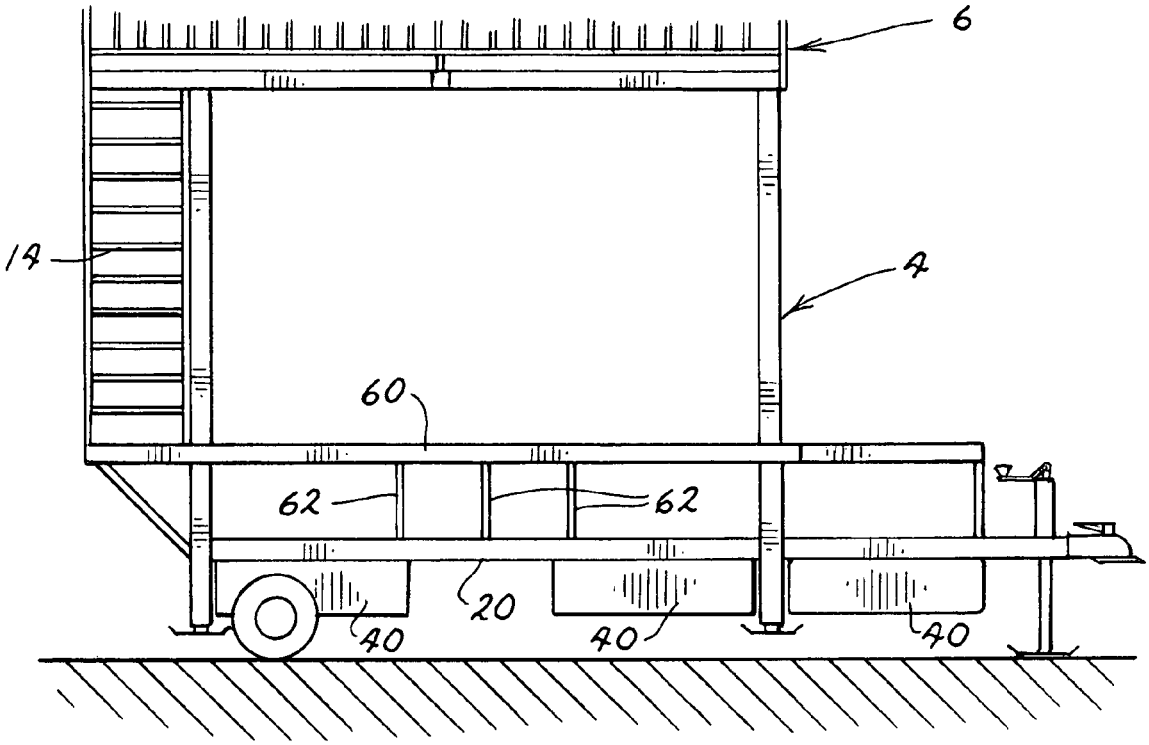
FIG. 9 is a side elevational view of another structure according to this invention, particularly illustrating a multi-level structure providing a deck on the lower level and an entertainment area on the upper level, the structure being shown disposed on the ground for ground transport.

Another embodiment of structure 2 is one where lower level 4 is not used to house a boat lift, but is instead used to provide a second or additional entertainment area. This is shown in FIG. 9. A solid weight bearing floor or deck 60 is installed on lower level 4 of structure 2 in place of boat lift 8. Such a lower deck 60 can be placed at the level of the bottom of stairway 14 and can itself be extended out from one end of structure 2 to form the landing for stairway 14. Lower deck 60 on lower level 4 can be braced or held above base 20 by a plurality of vertical spacers 62 or the like extending upwardly from base 20 to the underside of lower deck 60.

Figure 10:
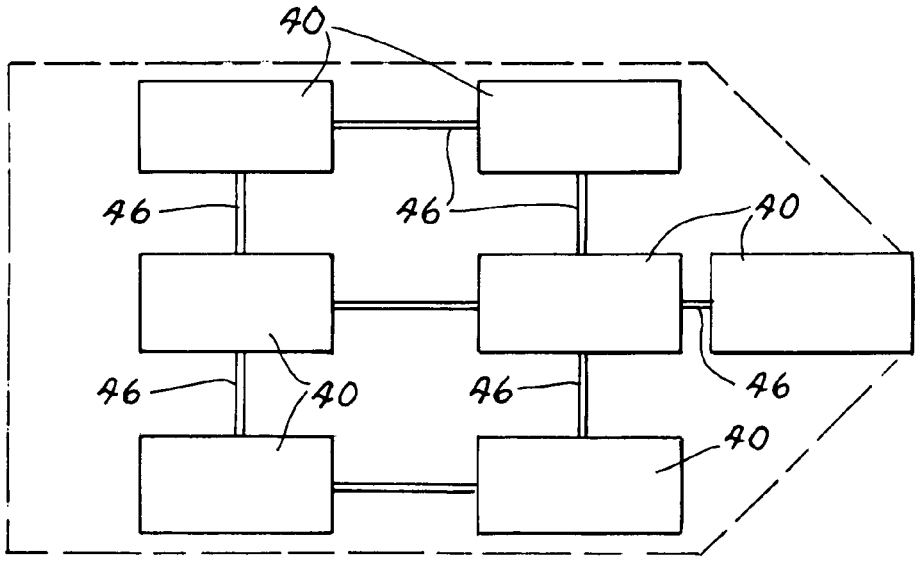
FIG. 10 is a diagrammatic bottom plan view of the structure of FIG. 9, particularly illustrating a single array of ballast tanks.

In this embodiment of structure 2 as shown in FIGS. 9 and 10, a plurality of ballast tanks 40 can be arranged in a single array beneath base 20 rather than being arranged in separate arrays along the sides of structure 2. All of tanks 40 in this single array can be interconnected together by hydraulic couplings 46. A bilge pump and fill valve are installed in one or more of the tanks 40 in the array. The single array of ballast tanks 40 is filled and operated in much the same way as when tanks 40 were disposed in multiple arrays, except that only a single pump and fill valve are used. Preferably, each ballast tank 40 still has its own individual air vent (not shown in FIGS. 9 and 10).

Figure 11:
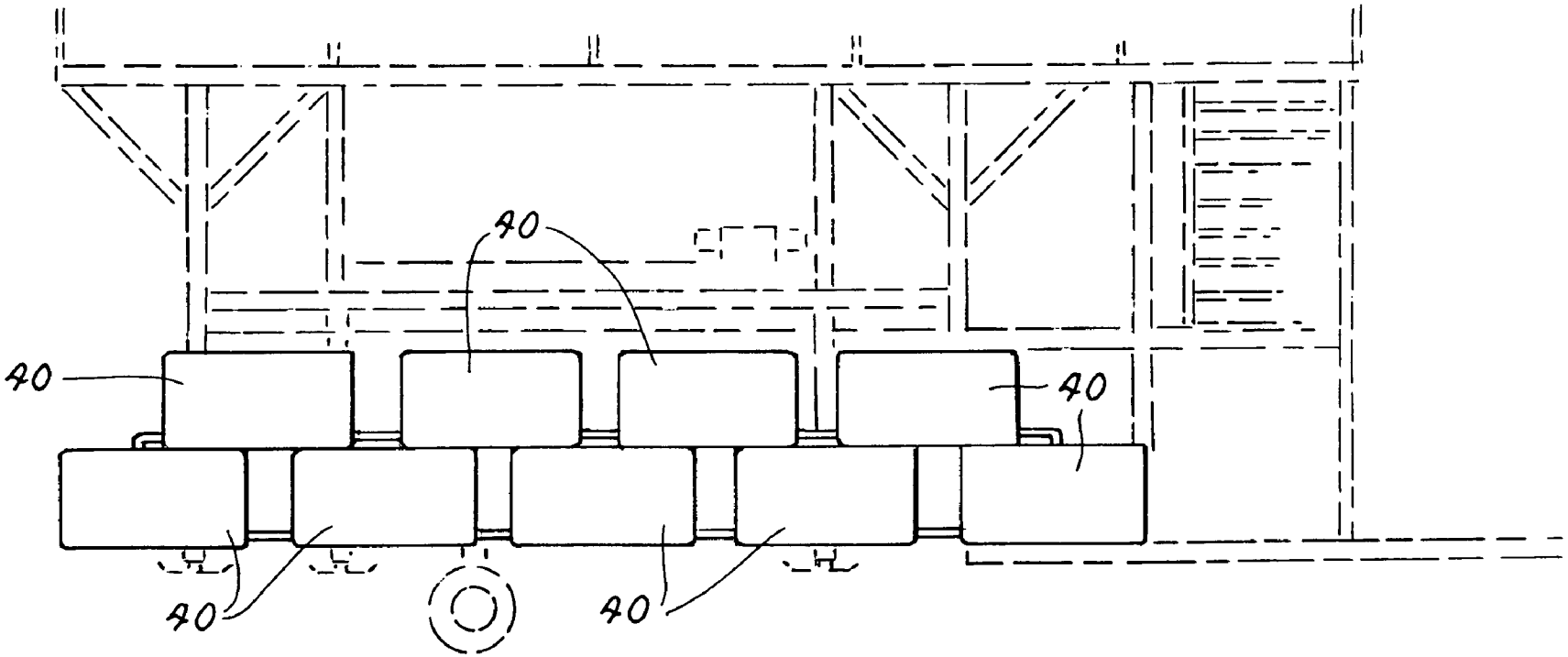
FIG. 11 is a side elevational view of the structure of FIG. 1, particularly illustrating an alternative in which the ballast tanks are carried on each side of the structure in an array comprising two horizontal rows of tanks that are vertically stacked on top of each other.

In another arrangement of ballast tanks as shown in FIG. 11, each row of ballast tanks in the embodiment of FIGS. 1–6 can be replaced by a multi-level row of ballast tanks to increase the amount of weight that can be added to structure 2 when tanks 40 are completely filled with water. In such a multi-level row, tanks 40 in upper rows can be offset relative to tanks 40 in the lower rows like bricks in a brick wall. Again, all tanks 40 in such a multi-level row will be interconnected together and a single bilge pump and fill valve can be placed into one of the tanks 40 in the lowest level of the plural stacked rows.

Figure 12:
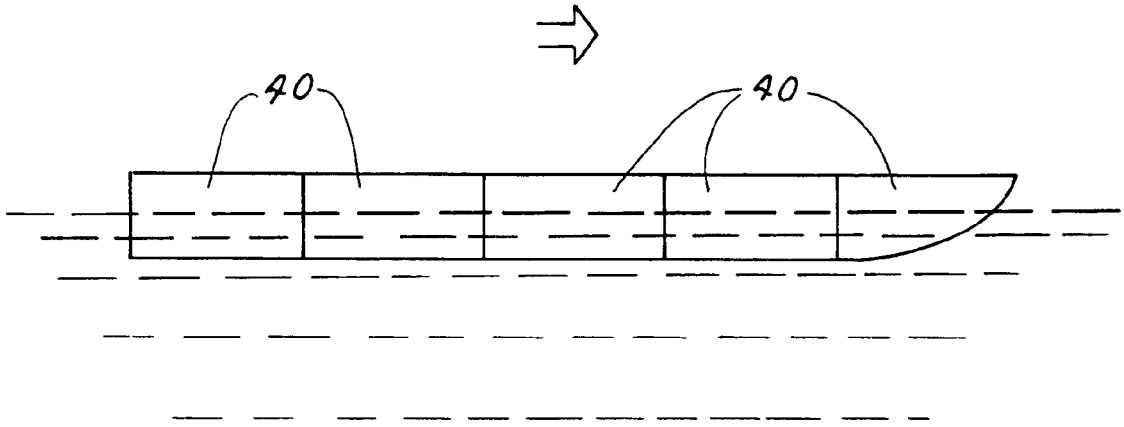
FIGS. 12 and 13 are diagrammatic side elevational views of an array of ballast tanks used with the structure of FIG. 1, particularly illustrating two alternatives in which the tanks within the array are shaped to have an overall front to back hull or torpedo like configuration, respectively, to aid in towing the structure through the water.
Figure 13:
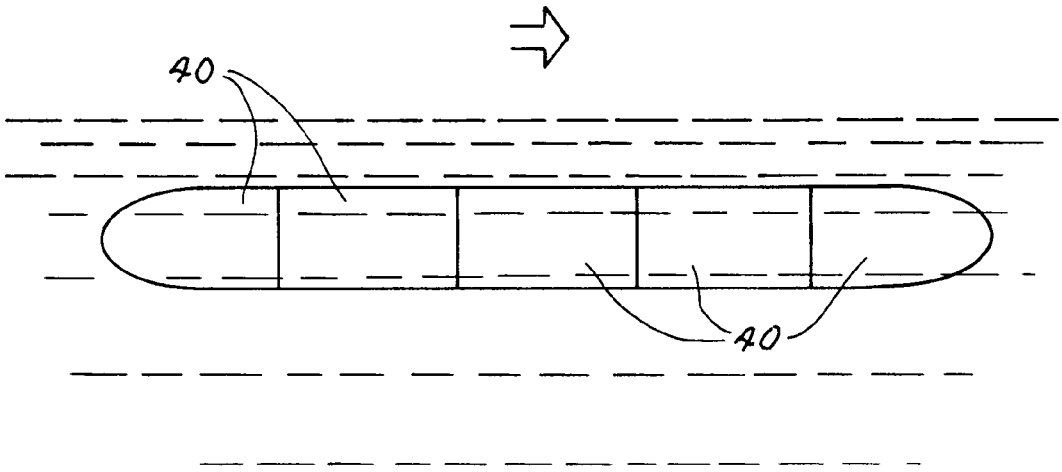

Referring now to FIGS. 12 and 13, tanks 40 in each row of tanks can be shaped relative to each other so that each row of tanks has an overall shape or configuration that more easily passes through the water during water transport of structure 2. FIG. 12 shows the five tanks 40 in each row thereof shaped much like a keel or hull (with the gaps between tanks 40 and couplings 46 being omitted for the sake of clarity). FIG. 13 shows the five tanks 40 in each row having an overall torpedo or bullet shape. Either of these configurations allows for smoother towing with less drag than the merely rectangular shape of the row of tanks as shown in FIGS. 1–6. Moreover, structure 2 will be very stable during water transport if structure 2 is towed with tanks 40 partially flooded and the torpedo or bullet shape of FIG. 13 largely submerged.

Figure 14:
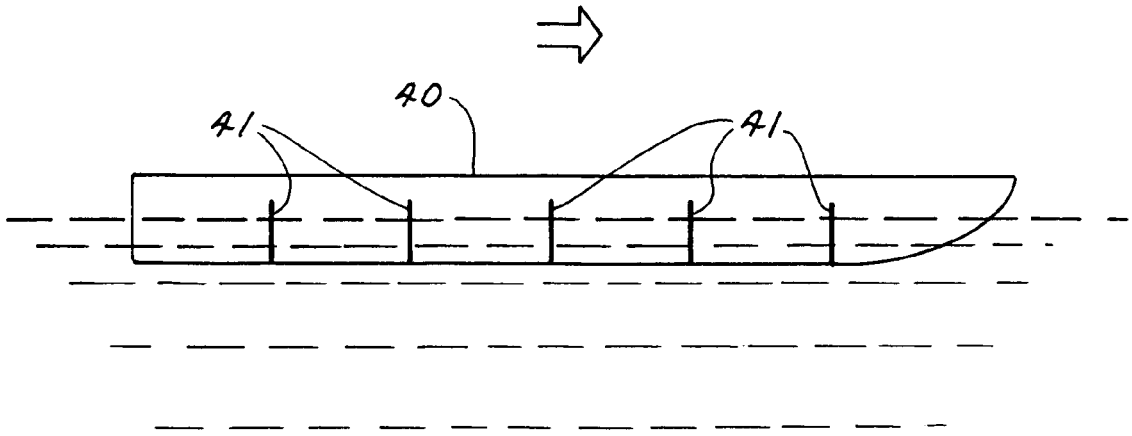
FIG. 14 is a diagrammatic side elevational view of a single large ballast tank used with the structure of FIG. 1, particularly illustrating a plurality of partial height baffles within the ballast tank.

FIG. 14 shows a ballast tank that can be used along each side of structure 2 or underlying structure 2 comprising a single long ballast tank 40 having an overall hydrodynamic shape like that shown in FIG. 12. Such a single large tank 40 would perhaps be more difficult and expensive to obtain, but actually presents less drag in the water than an array of separate, smaller, interconnected tanks even when such an array is hydrodynamically shaped as in FIGS. 12 and 13. Such a single large tank 40 would preferably have a plurality of internal, partial height, vertical baffles 41 that would have lower holes therein (not shown) to let the water slowly flow through the baffles 41 when water is being added or pumped from tank 40 so that tank 40 fills and drains evenly. However, during water transport of structure 2, baffles 41 would prevent any ballast water within tank 40 from sloshing to the rear of tank 40 as structure 2 crests a wave, thereby preventing instability and possible capsizing of structure 2.

Figure 15:
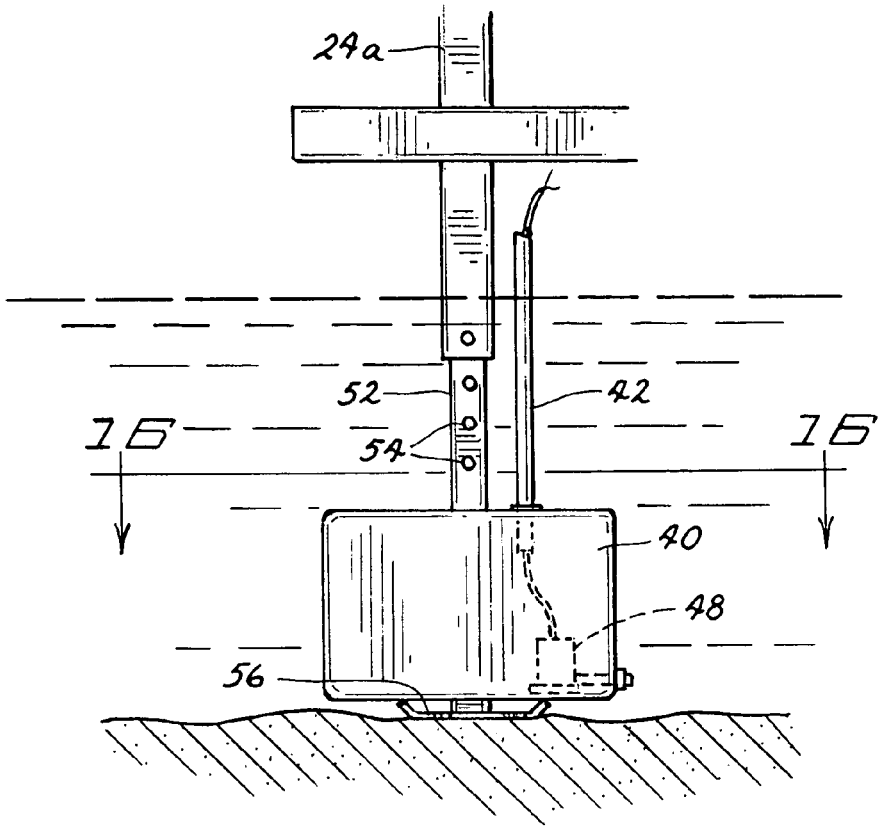
FIG. 15 is a partial side elevational view of one of the telescopic legs of the structure shown in FIG. 1, illustrating an alternative in which the ballast tanks are carried on the telescopic legs of the structure rather than on the sides of the structure.
Figure 16:
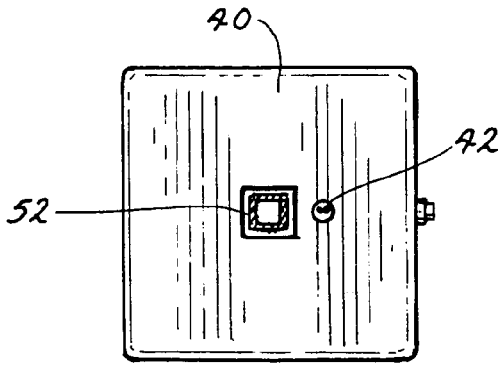
FIG. 16 is a cross-sectional view of the ballast tank alternative shown in FIG. 15 taken along lines 16—16 in FIG. 15.

FIGS. 15 and 16 illustrate an alternative way to carry tanks 40 on structure 2. Each ballast tank can be carried on one of the extendible legs 52 either in a fixed or slidable fashion. As tanks 40 are filled with water, the weight of tanks 40 will cause legs 52 to extend downwardly out of structure 2 until feet 56 on the lower ends of legs 52 engage against the bottom of the body of water. Alternatively, if tanks 40 are slidably carried on legs 52, legs 52 could be extended downwardly before tanks 40 are filled and then tanks 40 will slide down legs 52 as they are being filled. In any event, legs 52 can still be locked in place on structure 2 after they have engaged the bottom.

One advantage of placing tanks 40 on legs 52 of structure 2 is the fact that the weight or ballast provided by tanks 40 is located as low as possible, even lower than base 20 of lower level 4. However, one disadvantage of placing tanks 40 on legs 52 of structure 2 rather than somewhere else is the need to have individual pumps and fill valves for each tank along with snorkel tubes 42 that have a maximum length that will keep the upper ends of tubes 42 above the water line. One approach for such a snorkel tube would be to have a tube that would be a flexible, coiled tube that could unroll as tank 40 sinks to the bottom of the body of water.

Various other modifications will be apparent to those skilled in the art. For example, fill valve 44 could be placed in tank 40 that is at the rear end of structure 2 furthest from tongue 34. Then, when structure 2 is first removed from the body of water at the end of the season, structure 2 can be tipped to the rear about wheels 36 by elevating tongue 34. Fill valve 44 will then be the lowermost portion of the array of ballast tanks 40 and if opened can be used to drain any water that remains the ballast tanks 40 prior to storage of structure 2. Moreover, structure 2 could simply comprise a single level, weight bearing deck forming a section of a dock.

The use of one or more electrically operated bilge pumps 48 is preferred for evacuating ballast tanks 40 since such pumps 48 can pump the water out at synchronized, controllable, relatively slow rates. External manually operated pumps could also be used. However, a compressed air system could be substituted for pumps 48 to blow the water out of ballast tanks 40.

Ballast system 38 represents one type of buoyancy system that provides structure 2 with buoyant and non-buoyant states to float structure 2 on the body of water or to sink structure 2 in the body of water. Ballast system 38 does so by evacuating water therefrom or by adding water thereto, respectively.

Figure 17:
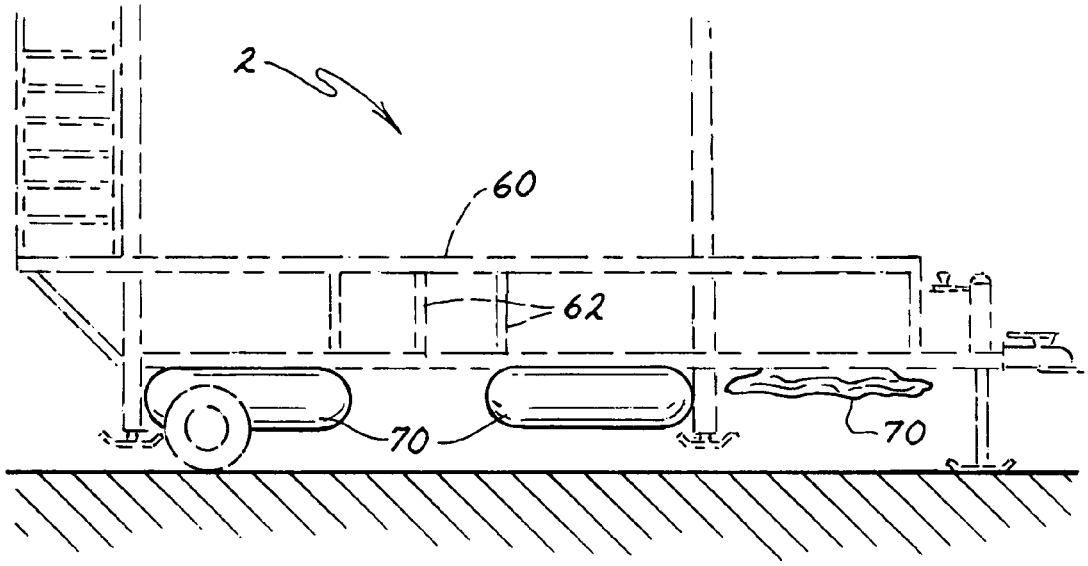
FIG. 17 is a side elevational view of another structure according to this invention, particularly illustrating an alternative buoyancy system comprising an inflatable bag or bladder system for selectively providing buoyancy to a multi-level structure, the structure being shown disposed on the ground for ground transport.

FIG. 17 illustrates an alternative buoyancy system which may be used in place of ballast system 38. In this alternative system, ballast tanks 40 are replaced with a plurality of flexible, inflatable air bags or bladders 70. FIG. 17 shows three such bladders 70 on structure 2 with two bladders 70 being shown fully inflated and expanded and one bladder 70 being shown fully uninflated and collapsed. The number of bladders 70 and their placement on structure 2 could obviously vary just as the number and placement of tanks 40 can vary.

Bladders 70 would have suitable air valves (not shown), similar to those used on pneumatic tires, to allow compressed air to enter and inflate bladders 70 and to allow such compressed air to be bled from and permit bladders 70 to collapse. Such bladders 70 would be inflated from a source of compressed air provided on structure 2 or externally of structure 2.

A buoyancy system comprised of inflatable bladders 70 is not preferred over ballast system 38. Bladders 70 are much more prone to being punctured and uninflated by being snagged or hooked on something than are ballast tanks 40, at least when such tanks 40 are made from a rigid plastic or metallic material as would usually be the case. One could attempt to protect bladders 70 by placing them well inside structure 2 beneath base 20, but even so it would still be somewhat likely that one or more bladders 70 would be punctured at some time, either when structure 2 was in the water or was out of the water. This would mean the repair or replacement of the damaged bladder(s) 70, which is obviously inconvenient and expensive.

While bladders 70 could be pneumatically linked together in groups or arrays to allow the groups or arrays to be simultaneously inflated and collapsed, the danger of bladder puncture would militate against this. Instead, it would be safest to use separate bladders 70 that are individually inflated and collapsed so that the puncture of one bladder 70 would not affect the inflated state of the remaining bladders 70. However, it would take more time and be more work to have to inflate and collapse each bladder 70 individually.

Yet another reason for preferring the use of ballast system 38 is that ballast system 38 adds significant weight to a light structure while inflatable bladders 70 have to provide buoyancy to a heavier structure. If one wants structure 2 to weigh 7,500 pounds when in the water, then one can build a 2,500 pound structure 2 equipped with ballast tanks 40. The ballast in the form of the water added to ballast tanks 40 makes up the difference. Thus, one only needs 2,500 pounds of materials to construct structure 2 and only this amount has to be towed by a tow vehicle.

The situation is the reverse if one uses a buoyancy system made of inflatable bladders 70. One has to start with a structure weighing 7,500 pounds meaning more material must be used in the construction of structure 2 and one now has to tow a 7,500 pound structure. Bladders 70 then must be sized to provide more than 7,500 pounds of buoyancy to allow structure 2 to float. Thus, ballast system 38 is far more economical and efficient when used on structure 2 than an inflatable system of flexible bladders 70.

Thus, the scope of this invention is to be limited only by the appended claims.

We claim:

1. A structure that may be used in a body of water, which comprises:

(a) a multi-level structure having a lower level and an upper level, wherein the lower level is tall enough to accommodate at least a watercraft therein, wherein the upper level includes a weight bearing deck that is strong enough to support a plurality of people and furniture in a first entertainment area on the structure, and wherein the lower level includes a plurality of uprights having upper ends which support an underside of the deck of the second level;

(b) at least a pair of wheels that can be at least temporarily attached to the lower level of the structure to allow the structure to be transported by ground to and from the body of water and to be rolled into and out of the body of water;

(c) a buoyancy system carried on the structure to selectively provide the structure with a buoyant state in which the structure floats on the body of water and a non-buoyant state in which the structure does not float on the body of water;

(d) a vertically movable boat lift provided in the lower level of the structure, the lower level of the structure being tall enough to accommodate the watercraft when the watercraft is held by the boat lift whether the boat lift is in a lowered position with the watercraft in contact with the body of water or is in a raised position with the watercraft raised above the body of water, and wherein the boat lift vertically slides up and down at least some of the deck supporting uprights of the lower level.

2. The structure of claim 1, wherein the buoyancy system comprises a system that is filled with pressurized air to provide the buoyant state of the structure and that is emptied of pressurized air to provide the non-buoyant state of the structure.

3. A structure that may be used in a body of water, which comprises;

(a) a multi-level structure having a lower level and an upper level, wherein the lower level is tall enough to accommodate at least a watercraft therein, and wherein the upper level includes a weight bearing deck chat is strong enough to support a plurality of people and furniture in a first entertainment area on the structure;

(b) at least a pair of wheels that can be at least temporarily attached to the lower level of the structure to allow the structure to be transported by ground to and from the body of water and to be rolled into and out of the body of water; and (c) a buoyancy system, carried on the structure to selectively provide the structure with a buoyant state in which the structure floats on the body of water and a non-buoyant state in which the structure does not float on the body of water, wherein the buoyancy system comprises a system that is filled with pressurized air to provide the buoyant state of the structure and that is emptied of pressurized air to provide the non-buoyant state of the structure, and wherein the buoyancy system comprises at least one flexible and inflatable air bag or bladder that is expanded when filled with pressurized air and is collapsed when emptied of pressurized air.

4. The structure of claim 3, wherein the wheels are pneumatic rubber wheels to permit ground transport of the structure over a roadway at higher than walking speeds.

5. The structure of claim 3, wherein a vertically movable boat lift is provided in the lower level of the structure, the lower level of the structure being tall enough to accommodate the watercraft when the watercraft is held by the boat lift whether the boat lift is in a lowered position with the watercraft in contact with the body of water or is in a raised position with the watercraft raised above the body of water.

6. The structure of claim 3, wherein the lower level of the structure is tall enough to accommodate standing people and includes a weight bearing deck that is strong enough to support a plurality of people and furniture in a second entertainment area on the structure.

* * * * *

UNITED STATES PATENT AND TRADEMARK OFFICE

CERTIFICATE OF CORRECTION

PATENT NO. : 7,216,602 B2
APPLICATION NO. : 11/175998
DATED : May 15, 2007
INVENTOR(S) : Carl K. Towley, III et al.

It is certified that error appears in the above-identified patent and that said Letters Patent is hereby corrected as shown below:

Col. 13, Line 24, change “chat” to --that--;
Col. 14, Line 1, delete the comma.

Signed and Sealed this

Seventeenth Day of July, 2007

JON W. DUDAS
*Director of the United States Patent and Trademark Office*